US006907738B1

(12) United States Patent
Berkeley et al.

(10) Patent No.: US 6,907,738 B1
(45) Date of Patent: Jun. 21, 2005

(54) PILOT AIR APPARATUS AND METHOD FOR A COMBUSTOR OF GAS TURBINE

(75) Inventors: Dalero Winston Berkeley, Greenville, SC (US); Robert A. McLeod, Greenville, SC (US); Michael Paul Black, Simpsonville, SC (US); Doug Dean, Greer, SC (US)

(73) Assignee: General Electric Company, Schenectady, NY (US)

( * ) Notice: Subject to any disclaimer, the term of this patent is extended or adjusted under 35 U.S.C. 154(b) by 5 days.

(21) Appl. No.: 10/826,353

(22) Filed: Apr. 19, 2004

Related U.S. Application Data

(63) Continuation of application No. 10/784,207, filed on Feb. 24, 2004.

(51) Int. Cl.[7] ..... F02C 7/22
(52) U.S. Cl. ..... 60/785; 60/740; 60/796
(58) Field of Search ..... 60/740, 785, 796, 60/802, 806

(56) References Cited

U.S. PATENT DOCUMENTS 5,185,997 A * 2/1993 Nishijima ..... 60/740
6,393,826 B1 * 5/2002 Yamanaka et al. ..... 60/785
6,792,762 B1 * 9/2004 Yamanaka et al. ..... 60/782

* cited by examiner

*Primary Examiner*—Louis J. Casaregola
(74) *Attorney, Agent, or Firm*—Nixon & Vanderhye, P.C.

(57) ABSTRACT

A pilot air system for a combustor of a gas turbine including: a pilot air compressor having inlet connectable to in to a main passageway, wherein the main passageway receives compressed air from a compressor for the gas turbine; a pilot air platform positioned adjacent to the combustor of the gas turbine, wherein the pilot air compressor is positioned on the platform; an inline throttling valve coupled to the first main passageway; a by-pass passageway for the pilot air, proximate to the platform, and arranged in parallel to the main passageway and compressor, wherein the by-pass passageway receives pilot air from the main passageway downstream of the pilot air compressor and passes a portion of the compressed pilot air to the main passageway upstream of the pilot air compressor; a by-pass throttling valve inline with the by-pass passageway to meter pilot air flowing through the by-pass passageway, and the main passageway having an outlet connectable to the combustor.

20 Claims, 4 Drawing Sheets

PILOT AIR APPARATUS AND METHOD FOR A COMBUSTOR OF GAS TURBINE

RELATED APPLICATION

This is a continuation application that claims priority to and the benefit of the filing date of co-pending U.S. patent application Ser. No. 10/784,207 filed Feb. 24, 2004, the entirety of which is incorporated by reference.

BACKGROUND OF THE INVENTION

The present invention relates to the field of combustors in gas turbines and specifically to pilot air technology for such combustors.

Gas turbines mix and combust fuel and compressed air in a combustor arranged between a compressor and turbine. Combustors for industrial gas turbines typically include an annular array of combustion cans that each include fuel and air nozzles. The combustion cans, fuel and air nozzles and other components of the combustors are arranged to provide efficient and low emission combustion of high pressure and high mass flow rates of compressed air, and liquid and/or gaseous fuel. The combustion system often includes primary and secondary fuel nozzles for liquid and gaseous fuels, and associated piping for the different fuel types. Water injection pipes and nozzles are also included in some combustion systems.

Pilot air has been applied to gas turbine combustors to (for example): assist in gaseous fuel combustion; purge secondary fuel pipes and nozzles, and purge water injection pipes and nozzles in the combustion system. Pilot air has also been used in conjunction with emission control technology that reduces nitrogen oxides (NOx) emissions from the combustion process. Compressed air taken from the main compressor is a common source of pilot air. The pilot air bled off from the main compressor may be boosted by a secondary compressor and applied to the combustor. Conventionally, the boosted pressure of pilot air has not been regulated or adjustable. There is a need to regulate the pressure level of the pilot air, especially in view of the different applications of the pilot air, e.g., for purging fuel and water injection pipes, assisting gaseous fuel flow, and for emission control.

BRIEF DESCRIPTION OF THE INVENTION

The invention may be embodied as a pilot air system for a combustor of a gas turbine including: a pilot air compressor having inlet connectable to in to a main passageway, wherein the main passageway receives compressed air from a compressor for the gas turbine; a pilot air platform positioned adjacent to the combustor of the gas turbine, wherein the pilot air compressor is positioned on the platform; an inline throttling valve coupled to the first main passageway; a by-pass passageway for the pilot air, proximate to the platform, and arranged in parallel to the main passageway and compressor, wherein the by-pass passageway receives pilot air from the main passageway downstream of the pilot air compressor and passes a portion of the compressed pilot air to the main passageway upstream of the pilot air compressor; a by-pass throttling valve inline with the by-pass passageway to meter pilot air flowing through the by-pass passageway, and the main passageway having an outlet connectable to said combustor.

In another embodiment, the invention is a pilot air skid for providing pilot air to a combustor of a gas turbine wherein the skid comprises: a platform positioned proximate to the gas turbine; a pilot air compressor positioned on the platform; a pilot air main passageway having an inlet adapted to receive compressed air discharged by a compressor of the gas turbine and having an outlet coupled to an inlet to the pilot air compressor; a first throttling valve in said main passageway; a by-pass passageway having an inlet joined to said main passageway downstream of the pilot air compressor and an outlet joined to said main passageway upstream of the pilot air compressor; a by-pass throttling valve coupled to said by-pass passageway, and an outlet of the pilot air main passageway connectable to the combustor of the gas turbine.

DETAILED DESCRIPTION OF THE INVENTION

A pilot air system has been developed that provides pilot air to secondary liquid fuel nozzles and water injection nozzles in a gas turbine combustor. The pilot air system provides sufficient pressure to the pilot air chamber of the fuel nozzle body to maintain the pressure of the pilot air at a pressure ratio (PR) of approximately 1.05 to 1.25 above the pressure of the main compressor discharge air over the full operating rang of the turbine. The pilot air system provides pressure regulation and pressure adjustment of the pilot air to the fuel nozzles and water injection nozzles of a combustor.

Figure 1:
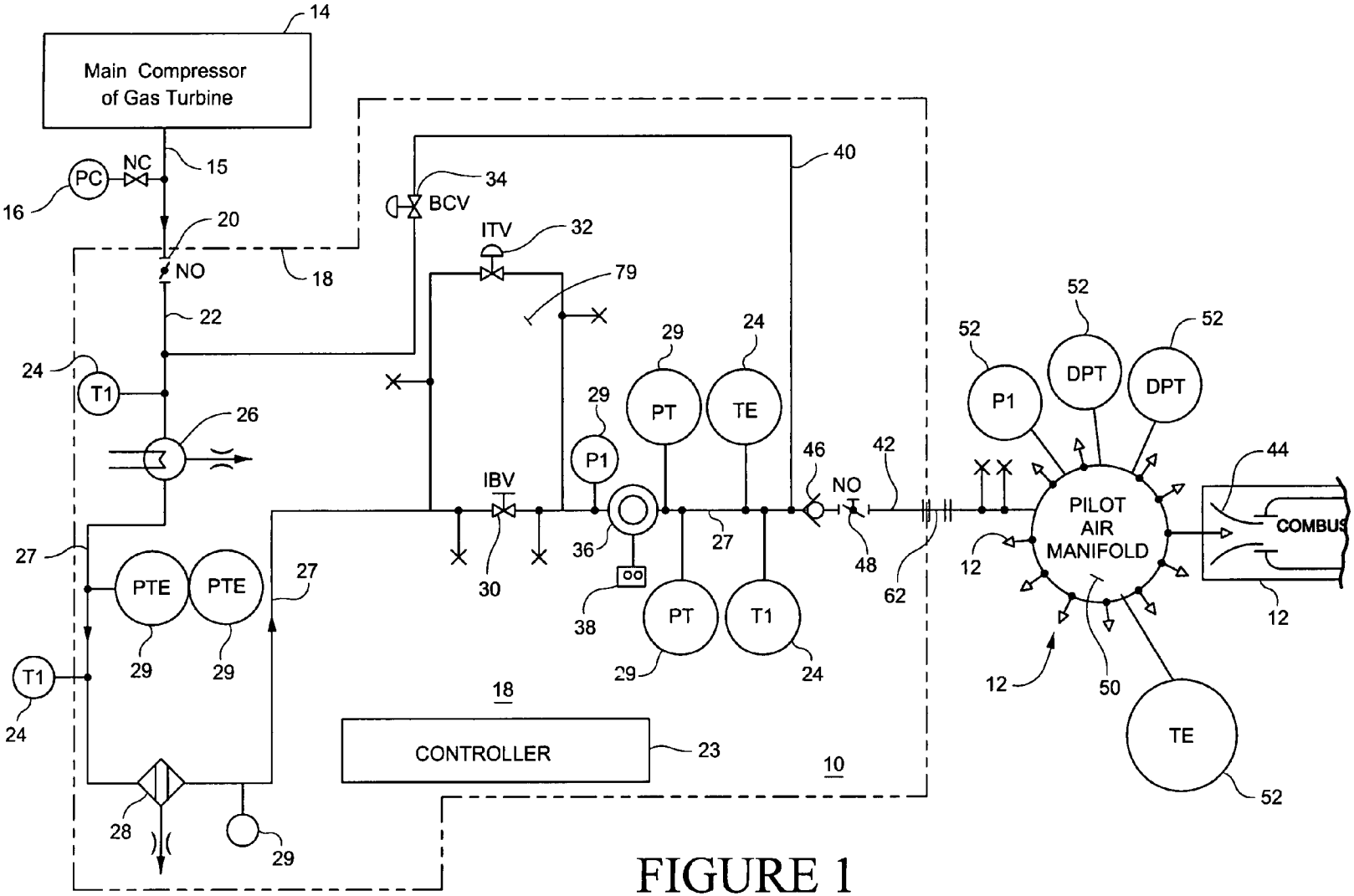
FIG. 1 is a schematic diagram of a pilot air system, and associated pilot air manifold and combustion cans.

FIG. 1 is a schematic diagram of a pilot air system 10 and an associated array of combustion cans 12 for a gas turbine. A small portion of the compressor discharge air is taken for use as pilot air from a main compressor 14 of the gas turbine. The pilot air is a small fraction of the total compressed air discharged by the compressor. The compressor discharge air varies in pressure and temperature depending on the operating condition of the compressor and the load on the gas turbine. For example, the pilot air extracted from the compressor discharge may be at a pressure of 191 psia (pounds per square inch atmospheric), at a temperature of 697° F. to 710° F., and have a mass flow rate of 0.714 to 1.317 pounds per second. A pressure check valve (PC) 16 is coupled to the pipe 15 connecting the compressor discharge to the pilot air system. The PC valve is normally closed (Nc), but may open to release excessive pressure in the inlet pipe 15.

Figure 2:
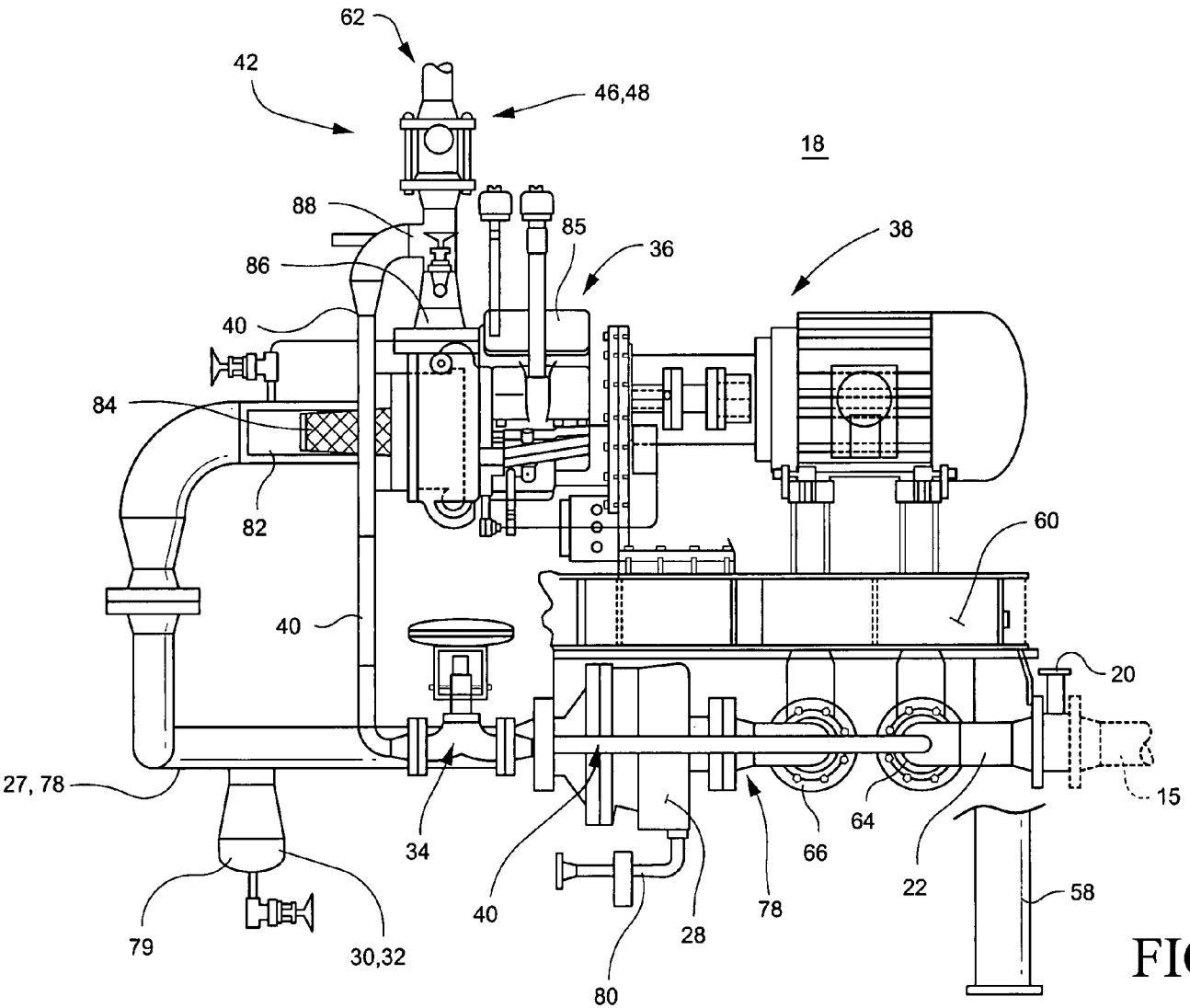
FIG. 2 is a side schematic view of a pilot air skid for the pilot air system.
Figure 4:
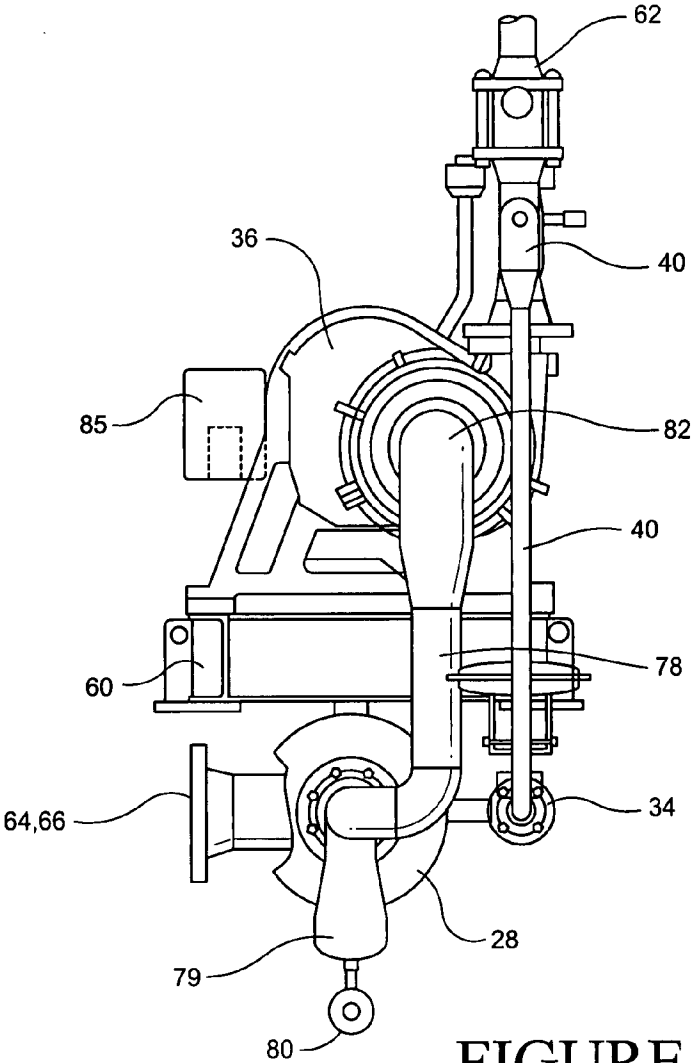
FIGS. 3 and 4 are schematic views of opposite ends of the pilot air skid.
Figure 3:
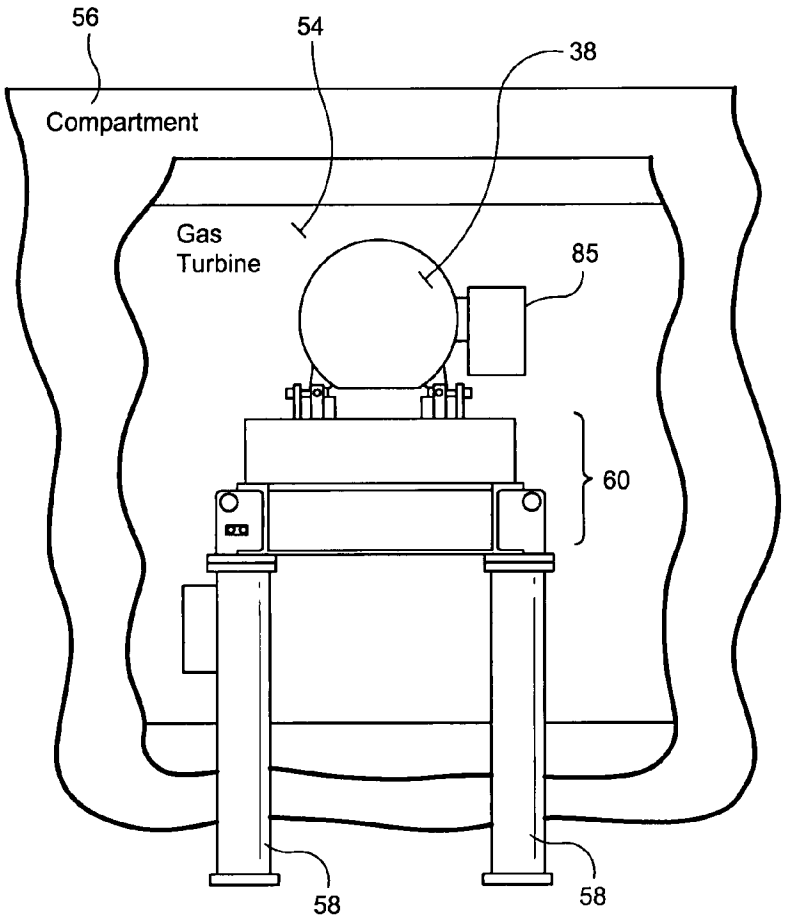

The compressor discharge air is bled off to a pilot air skid 18, which is shown in FIGS. 2 to 4. The skid comprises an arrangement of pipes, valves, a compressor and instruments to provide pilot air to the combustion chambers of a gas turbine. A pipe 15 carrying the compressor discharge air couples to the pilot air skid at or just upstream of a butterfly valve 20, that is normally open (NO). The butterfly valve may be closed to isolate the pilot air system from the main compressor 14 if, for example, a water wash is applied to the compressor inlet.

During normal operation, the pilot air from the compressor discharge flows via pipe 15 into the inlet pipe 22 of the pilot air system 10. A temperature sensor 24 determines a temperature of the compressed pilot air. A heat exchanger 26 cools the air to a temperature that may be determined by a computer controller 23 for the pilot air system. The heat exchanger 26 may be an air to air heat exchanger with a variable frequency drive that enables the controller 23 to regulate a cooling fan associated with a radiator through which flows the pilot air. The heat exchanger may or may not be physically mounted on the skid 18.

Pilot air temperature and pressure are dependent on each other. Pilot air pressure can be regulated (within certain ranges) by using the controller 23 and heat exchanger 26 to adjust the temperature of the pilot air. The controller 23 receives as inputs sensor signals from various temperature sensors 24 and pressure temperature sensors 29 that monitor the pilot air in the system 10. The temperature sensors may be dual element thermocouples. The controller may adjust the cooling (and hence the pressure) of the pilot air based on a temperature difference between the temperature sensors upstream and downstream of the heat exchanger of the heat exchanger, and a desired air temperature difference as determined by the controller. The downstream temperature may be measured, for example, at a pilot air manifold 50 in the combustor. The pilot air may be cooled to, for example, 150° F. by the heat exchanger. The pressure of the cooled air passing through the heat exchanger remains at substantially the same pressure level as the compressor discharge air pressure, e.g., 191 psia. Alternatively, the heat exchanger may cool the pilot air in a continuous manner and not subject to regulation by the controller.

Cooled compressed air flows through a main pilot air pipe 27 from the heat exchanger to a moisture separator and air filter 28 that traps and extracts moisture and dirt from the air. In addition, steam traps downstream of the moisture separator collect contaminants in the pilot air. A throttling inline butterfly valve (IBV) 30 downstream of the separator-filter 28 provides a first pressure regulation valve for the pilot air. The IBV valve 30 is immediately upstream of a pilot air compressor 36.

The IBV valve 30 serves as a variable orifice for pressure regulation of pilot air flowing through the compressor and on to the end-cover 44 for each of the combustor cans 12. The IBV valve 30 operates in conjunction with a second inline throttling valve (ITV) 32, and a throttling by-pass control valve (BCV) 34 (which may be structurally the same as the other throttling valves 30 and 32). The ITV and IBV valves 30, 32 may be housed in a single valve mechanism 79 as is indicated in FIG. 2.

The three throttling control valves 30, 32 and 34 (and optionally in conjunction with the heat exchanger), provide pressure control to adjust the amount of pressure boost given to the pilot air. The pressure boost is provided by the compressor 36, which may be driven by a motor and drive gear 38. The compressor may be driven at a uniform speed. The exact ratio of the pressure boost, e.g., pilot air manifold pressure over compressor discharge pressure, is determined by the settings of the throttling valves. These valves may be adjusted to provide a pressure boost ratio in a range of 1.05 to 1.25, wherein the boost is the pressure ratio of the pilot air at the pilot air manifold 50 to the compressor discharge air at the inlet 22 of the pilot air system 10. The range of boosted pressure ratios for the pilot air may be determined based on engineering considerations for the pilot air system and may be a wider range, e.g., 1.00 to 1.50, than the exemplary range for the pilot air boost disclosed herein.

The exact value of the pressure boost within the range may be determined by the controller operating the throttling valves and (optionally) the heat exchanger. Alternatively, the throttles may be manually operated and the controller 28 is unnecessary. Temperature 24, 52 and pressure sensors 29 upstream and downstream of the compressor provide data to the controller 23 regarding the pressure boost provided to the pilot air.

A by-pass pipe 40 directs a portion of the pilot air downstream of the compressor 36 to the inlet pipe 22 of the main pilot air pipe 27. The throttling valve 34 in the by-pass pipe may regulate the pressure in the by-pass pipe to prevent excessive flow of boosted pilot air to the inlet pipe and to assist with the regulation of the boosted pilot air pressure. The by-pass pipe with the by-pass throttling valve 34 provides a flow path for pilot air boosted by the compressor that is open even if the outlet 42 of the pilot system is closed. The by-pass pipe recirculates a portion of the pilot air through the skid and the compressor 36. The by-pass valve 34 is adjusted to provide a slight pressure drop in the pilot air in the by-pass pipe. The by-pass pipe 40 provides surge protection for the compressor 36 by allowing pilot air from the compressor 36 to flow even if the outlet 40 of the main pipe 27 is blocked.

The outlet 40 of the main pilot air pipe includes a ball valve 46 and a normally open (NO) butterfly valve 48. The ball valve remains open provided that the pilot air pressure in the outlet remains above some level set by the ball valve. The ball valve automatically closes if the pilot air pressure drops excessively, such as if there is a breach in the pilot air piping between the skid and the combustors. The butterfly valve 48 may be closed manually or under command of the controller 23 to close the outlet 40 of the pilot air system.

The outlet 40 of the pilot air system is coupled to, for example, a pilot air manifold 50 that may be an octopus manifold arrangement of pilot air pipes to each of the end covers 44 of the combustor cans 12 in a gas turbine. The condition of the pilot air at the outlet 40 includes a boosted pressure at a pressure level above the pressure of the compressor discharge air. The boosted pressure of the pilot air may be at a pressure level slightly greater than the pressure of the compressor discharge air, e.g., a boosted pressure that is 1.05 to 1.25 times the compressor discharge pressure. The boosted pilot air may be at temperature that is substantially cooler than the compressor discharge air. For example, the pilot air temperature may be in a range of 175° F. to 275° F. and preferably 225° F. In comparison, the compressor discharge air temperature may be in a range of 697° F. to 710° F. The mass flow of the pilot air, e.g., 1.317 pounds per second, is substantially lower than the mass flow of the compressor discharge air flowing into the combustor cans 12.

A pair of delta pressure transmitters 52 on the pilot air manifold 50 measure, in conjunction with a pressure sensor 24 at the pilot air inlet 22, a difference in pressure between the manifold and the compressor discharge pressure (PCD). This difference, which is the pressure difference of pilot air pressure in manifold and the PCD. The pressure difference is received by the controller 23, and applied to regulate the temperature drop of the pilot air in the heat exchanger. By controlling the pilot air temperature, the controller 23 can adjust the pressure boots (PR) applied to the pilot air within some range, such as from 1.05 to 1.25. If the throttling valves 30, 32 and 34 are automated and in communication with the controller, the pressure boost applied to the pilot air may also be automatically adjusted by the controller operating the throttling valves. The amount of pressure boost to the pilot air is determined by the throttling settings of the throttle valves 30, 32 and 34, and the cooling in the heat exchanger. The amount of pressure boost may be, for example, a selected pressure ratio of the outlet pilot air (at outlet 40) to the compressor discharge pressure (at the pilot skid inlet) in a range of 1.05 to 1.25. The controller may adjust the fan speed to control the temperature of the pilot air. The pressure regulation may be to adjust the pressure boost applied to the pilot air such that the pilot air pressure (when applied to the combustor) is at a selected pressure ratio above 1.0 with respect to the compressor discharge pressure. The selected pressure ratio of the pilot air may be in a range of 1.05 to 1.25.

The pilot air may be provided to the endcover 44 of the combustor 12, e.g., an array of combustion cans 12, in conjunction with emission control technology applied to the combustion process. Pilot air at a slightly greater pressure than the compressor discharge air may be applied to combustors 12 to improve the combustion of fuel in the combustors. Regulating the pressure of the pilot air provides greater control of the combustion process and may improve the ability of emission control technology to reduce noxious combustion emissions.

By way of example, the pilot air system may be operated according to predetermined schedules. An exemplary schedule may include the following steps.

At gas turbine startup, the inlet butterfly valve 20 is fully opened to the pilot air system and output butterfly valve 48 is closed. The BCV and IBV throttling valves 34 are fully opened, and the ITV valve 32 is closed. Also during startup, the gas turbine is accelerated to 95% speed of the speed at full load.

As the gas turbine reaches 95% speed, the outlet butterfly valve 48 is opened to supply pilot air to the pilot air manifold 50 for the end covers of the combustors 12. During gas turbine operations at 95% speed and above, the throttle control valves may be adjusted to control the pilot air. For example, to achieve a high pilot air pressure ratio (pilot air/compressor discharge air) of 1.25 the throttling valves IBV 30 and BCV 34 may be 100% open. To reduce the pilot air pressure ratio to a minimum value, e.g., 1.05, the IBV may be turned to a 20% open position and the BCV valve turned to a 75% open position. Moreover, the ITV valve may be maintained in a closed position. The ITV valve may be operated as a back-up throttling valve for the IBV valve and/or as a coarse/fine pilot air adjustment when operated in conjunction with the IBV valve.

During gas turbine shut down, the pilot air system is disengaged from the combustor by closing the outlet butterfly valve 48, while the throttling BCV and IBV valves 30, 34 remain open.

FIG. 2 is a schematic side view of an exemplary pilot air skid 18, and FIGS. 3 and 4 are schematic end views of the skid 18. The pilot air skid 18 is an apparatus to provide pilot air to the combustors 12 of a gas turbine and to regulate the pressure of the pilot air. FIG. 3 illustrates that the skid is positioned transverse and adjacent to the combustor section of a gas turbine 54. If the gas turbine is housed in a compartment 56, the skid may extend through opposite side walls of the compartment (if the compartment is not sufficiently wide to accommodate the entire skid).

The skid includes a pair of pedestals 58 which support and elevate the motor and gear drive 38 and the compressor 36. A platform 60 mounted on top of the pedestal support the motor and gear, compressor and other piping components of the skid. The elevation of the compressor may be such that the compressor is at a similar height as is the combustor of the gas turbine. FIG. 2 shows a portion of the platform 60 and one pair of legs of the pedestal 58. The platform may extend horizontally further than is shown in FIG. 2 and the pedestal may include additional legs to support the pedestal.

A flange outlet coupling 62 connects the outlet pipe 42 of the skid to a pipe conveying the pilot air to the pilot air manifold 50 (FIG. 1) of the combustor. The by-pass pipe 40 extends vertically downward from a pipe joint upstream (with respect to the flow of pilot air) of the outlet coupling 62 to the by-pass throttling valve 34 that is below the platform 60. The by-pass pipe 40 continues from the valve 34 in a horizontal direction to the inlet pipe 22 for the skid 18. The inlet pipe 22 has the inlet butterfly valve 20 downstream of the coupling for the skid to receive the compressor discharge air. The inlet pipe 22 has a heat exchanger inlet coupling 64 extending off to the side of the skid platform and pedestal. A return coupling 66 from the heat exchanger is aligned with the inlet coupling 64 and both are arranged underneath the platform.

Figure 5:
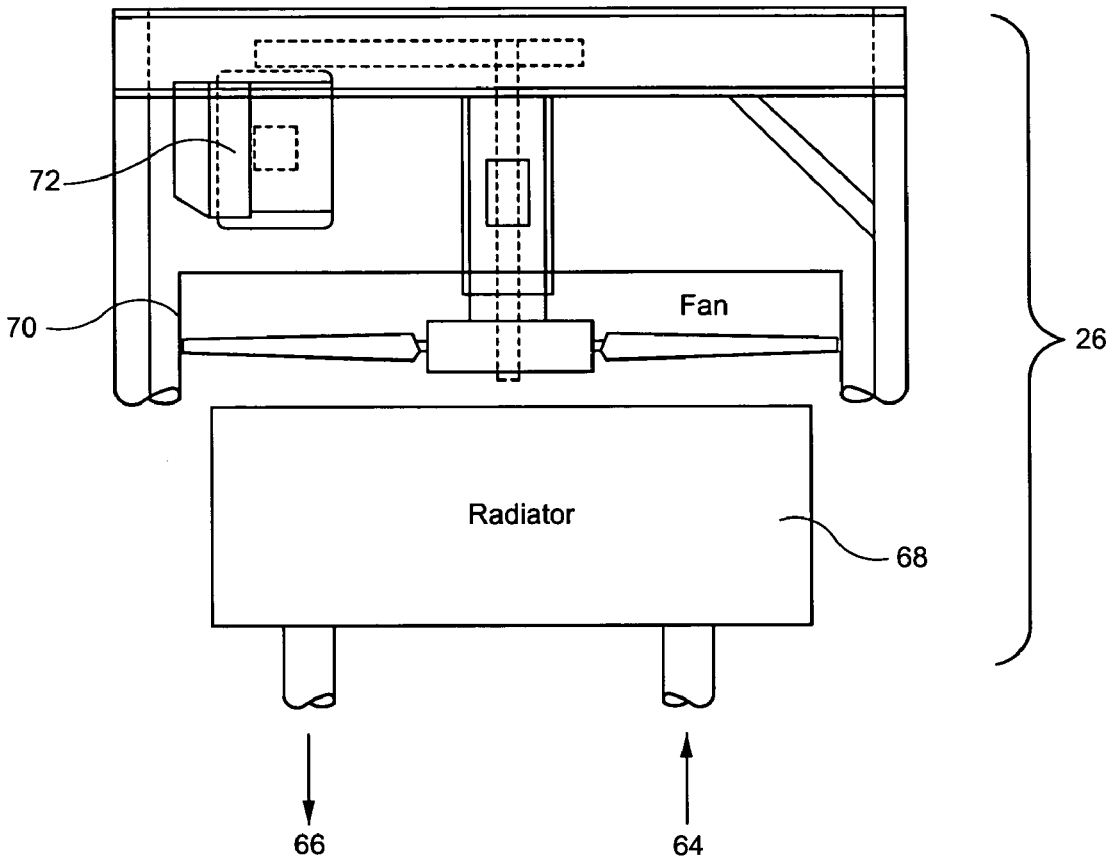
FIG. 5 is a schematic side view of a cooling fan in a heat exchanger used in conjunction with the pilot air skid.

FIG. 5 is a side view of the heat exchanger 26 that may be positioned to the side of the pedestal and platform 58, 60 of the skid. The heat exchanger may be directly coupled to the pilot air couplings 64, 66 and positioned below the platform 60, such below the platform and between the pedestals 58 or off to a side of the pedestals a side of the pedestal 58. The heat exchanger may also be positioned at some distance from the pilot air skid and connected to the skid by piping. The heat exchanger includes a radiator 68 having piping through which flows the pilot air from the outlet 66 of the inlet pipe 22 to an inlet 64 of the return pipe 78. A variable speed fan 72 is mounted above the radiator and blows cooling air over the radiator. A variable speed drive 74 rotates the fan at a speed determined by the controller 23. The fan, drive and radiator may be mounted in a frame 76 that is adjacent the skid 18 or remote from the skid.

The cooled pilot air returns from the heat exchanger to the skid 18 through return coupling 66 and to the pilot air main pipe 78, which is axially aligned with the inlet pipe 22 underneath the platform 60. The main pipe 78 feeds the pilot air to the moisture separator and air filter 28. Moisture and dirt are extracted from the pilot air through a discharge passageway 80. The main pipe includes the first and second inline throttling valves 30, 32 that may be manually adjusted or automatically controlled by the controller 23. The inline throttling valves are housed in a common valve housing 79.

The main pipe 78 turns vertically upward downstream of the valve 30 and connects to the input 82 at the center the centrifugal air compressor. The input may include an internal particle trap 84 to capture debris in the pilot air before entering the compressor. A control box 85 attached to the compressor housing includes the controller 23 for the pilot air system. The controller has connections for wiring that extends to the pressure and temperature sensors 24, 29 that monitor the pilot air in the skid 18. The compressor discharge 86 is coupled to the joint 88 for the by-pass valve and the outlet 42 of the skid.

The skid 18 is a relatively compact arrangement of pipes, compressor, and other components of the pilot air system. The skid is positioned adjacent the combustor of a gas turbine during installation of the turbine or as an add-on feature to an existing gas turbine. The skid provides a compact structure to provide pilot air to a gas turbine, wherein the pilot air system includes controls, e.g., throttling valves, for adjusting the pressure of the pilot air to the combustor.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A pilot air system for a combustor of a gas turbine, the system comprising:

a pilot air compressor having inlet connectable to in to a main passageway, wherein said main passageway receives compressed air from a compressor for the gas turbine;

a pilot air platform positioned adjacent to the combustor of the gas turbine, wherein said pilot air compressor is positioned on said platform;

an inline throttling valve coupled to the first main passageway;

a by-pass passageway for the pilot air, proximate to the platform, and arranged in parallel to the main passageway and the pilot air compressor, wherein said by-pass passageway receives pilot air from the main passageway downstream of the pilot air compressor and passes a portion of the compressed pilot air to the main passageway upstream of the pilot air compressor;

a by-pass throttling valve inline with said by-pass passageway to meter pilot air flowing through said by-pass passageway, and said main passageway having an outlet connectable to said combustor.

2. A pilot air system as in claim 1 further comprising a heat exchanger in series with said main passageway downstream of the inlet and upstream of the pilot air compressor, wherein said heat exchanger is positioned below the platform.

3. A pilot air system as in claim 2 wherein said heat exchanger is an adjustable heat exchanger and further comprises a variable speed fan and a radiator in series with said main passageway.

4. A pilot air system as in claim 2 wherein said heat exchanger is remote from the platform.

5. A pilot air system as in claim 1 wherein said platform is supported by at least one pedestal.

6. A pilot air system as in claim 1 wherein said platform extends through a housing enclosing the gas turbine.

7. A pilot air system as in claim 1 wherein said inline throttling valve is a first and second throttling valve in a common valve housing.

8. A pilot air system as in claim 1 wherein said outlet is connectable to a pilot air manifold of said combustor.

9. A pilot air system as in claim 1 wherein said throttling valves adjust an increases in pilot air pressure such that a pressure of the pilot air at the outlet is in a range of 1.00 to 1.50 of the pilot air pressure at the inlet.

10. A pilot air system as in claim 1 wherein said throttling valves adjust an increases in pilot air pressure such that a pressure of the pilot air at the outlet is in a range of 1.05 to 1.25 of the pilot air pressure at the inlet.

11. A pilot air skid for providing pilot air to a combustor of a gas turbine wherein the skid comprises:

a platform positioned proximate to the gas turbine;

a pilot air compressor positioned on the platform;

a pilot air main passageway having an inlet adapted to receive compressed air discharged by a compressor of the gas turbine and having an outlet coupled to an inlet to the pilot air compressor;

a first throttling valve in said main passageway;

a by-pass passageway having an inlet joined to said main passageway downstream of the pilot air compressor and an outlet joined to said main passageway upstream of the pilot air compressor;

a by-pass throttling valve coupled to said by-pass passageway, and an outlet of the pilot air main passageway connectable to the combustor of the gas turbine.

12. A pilot air system as in claim 11 wherein said main passageway further comprises inlet and outlet connections to a heat exchanger for cooling pilot air in the main passageway.

13. A pilot air system as in claim 12 wherein said heat exchanger further is an adjustable heat exchanger and further comprises a variable speed fan and a radiator inline with said main passageway.

14. A pilot air system as in claim 11 wherein said heat exchanger is remote from the platform.

15. A pilot air system as in claim 11 wherein said platform is supported by at least one pedestal.

16. A pilot air system as in claim 11 wherein said platform extends through a housing enclosing the gas turbine.

17. A pilot air system as in claim 1 wherein said inline throttling valve is a first and second throttling valve in a common valve housing.

18. A pilot air system as in claim 1 wherein said outlet is connectable to a pilot air manifold of said combustor.

19. A pilot air system as in claim 11 wherein said throttling valves adjust an increases in pilot air pressure such that a pressure of the pilot air at the outlet is in a range of 1.00 to 1.50 of the pilot air pressure at the inlet.

20. A pilot air system as in claim 11 wherein said throttling valves adjust an increases in pilot air pressure such that a pressure of the pilot air at the outlet is in a range of 1.05 to 1.25 of the pilot air pressure at the inlet.

* * * * *

UNITED STATES PATENT AND TRADEMARK OFFICE

CERTIFICATE OF CORRECTION

PATENT NO. : 6,907,738 B1
APPLICATION NO. : 10/826353
DATED : June 21, 2005
INVENTOR(S) : Dalero Berkeley et al.

It is certified that error appears in the above-identified patent and that said Letters Patent is hereby corrected as shown below:

On the cover page, Item (75), please correct the inventors to read as follows:

(75) Dalero Winston Berkeley, Greenville, SC (US); Robert A. McLeod, Greenville, SC (US); Michael Paul Black, Simpsonville, SC (US); Doug Dean, Greer, SC (US); Andres Garcia-Crespo, Greenville, SC (US).

Signed and Sealed this

Twenty-second Day of January, 2008

JON W. DUDAS
*Director of the United States Patent and Trademark Office*